US005122775A

United States Patent [19]

Fang et al.

[11] Patent Number: 5,122,775

[45] Date of Patent: Jun. 16, 1992

[54] CONNECTION DEVICE FOR RESISTIVE ELEMENTS

[75] Inventors: Shou-Mean Fang, Union City; Vijay K. Dhingra, Fremont; Chi-Ming Chan, Cupertino; Daniel Chandler, Palo Alto, all of Calif.

[73] Assignee: Raychem Corporation, Menlo Park, Calif.

[21] Appl. No.: 479,801

[22] Filed: Feb. 14, 1990

[51] Int. Cl.[5] ..... H01C 7/02; H01C 7/10

[52] U.S. Cl. ..... 338/22 R; 29/612

[58] Field of Search ..... 338/22 R, 22 SD, 221, 338/220, 204, 273, 276, 331, 333; 29/612

[56] References Cited

U.S. PATENT DOCUMENTS 3,351,882 11/1967 Kohler et al. .
4,188,276 2/1980 Lyons et al. .
4,237,441 12/1980 van Konynenburg .
4,238,812 12/1980 Middleman et al. .
4,327,351 4/1982 Walker .
4,352,083 9/1982 Middleman et al. .
4,388,607 6/1983 Toy et al. .
4,413,301 11/1983 Middleman et al. .
4,426,633 1/1984 Taylor .
4,445,026 4/1984 Walker .
4,481,498 11/1984 McTavish et al. .
4,514,620 4/1985 Cheng et al. .
4,545,926 10/1985 Fouts et al. .
4,560,498 12/1985 Horsma et al. .
4,624,990 11/1986 Lunk et al. .
4,685,025 8/1987 Carlomagno .
4,689,475 8/1987 Matthiesen .
4,774,024 9/1988 Deep et al. .
4,800,253 1/1989 Kleiner et al. .
4,845,838 7/1989 Jacobs et al. .
4,935,156 6/1990 van Konynenburg et al. .
4,980,541 12/1990 Shafe et al. .

FOREIGN PATENT DOCUMENTS 38713 10/1981 European Pat. Off. .
WO89/00755 1/1989 World Int. Prop. O. .

*Primary Examiner*—Marvin M. Lateef
*Attorney, Agent, or Firm*—Marguerite E. Gerstner; Timothy H. P. Richardson; Herbert G. Burkard

[57] ABSTRACT

An electrical device in which a first connection element is in electrical contact with a resistive element. The first connection element defines a cavity into which, when the cavity is empty, a second connection element can be inserted. The second connection element, which may be connected to a source of electrical power, is partially within the cavity, makes physical and electrical contact with the first connection element, and protrudes from the cavity. Such devices can be made in a continuous process by a method of the invention. They are particularly suitable for insertion into a circuit board.

9 Claims, 2 Drawing Sheets

CONNECTION DEVICE FOR RESISTIVE ELEMENTS

BACKGROUND OF THE INVENTION

1. Field of the Invention

This invention relates to electrical devices comprising a resistive element and a connection element attached thereto.

2. Introduction to the Invention

Many electrical devices comprise a resistive element and at least one connection element, the connection element comprising (a) a first portion which is directly attached to, e.g. embedded in, the resistive element, and (b) a second portion which extends outwards from the resistive element and which is connected to the remainder of the circuit. Usually there are two such connection elements of identical characteristics. A number of methods have been used, or proposed, for manufacturing such devices. These methods include processes in which the resistive element is formed by shaping a suitable material into a continuous strip or sheet, and then cutting the strip or sheet into discrete elements. In one such method, the connection element is attached to the resistive material after it has been shaped, either before or after the shaped resistive material is cut into discrete elements. In another method, the resistive material is shaped around an elongate preconnection element, e.g. by extruding a conductive polymer over a pair of wires; the extrudate is cut into discrete lengths; and a part of the resistive material is removed so as to expose the connection element. In another method, the resistive material is shaped against one or more preconnection elements, e.g. a conductive polymer is laminated as a sheet between two metal foils; the resulting product is cut into discrete parts, and leads (which become the second portion of the connection element) are secured to the exposed parts of the connection elements. In another method, the resistive material is shaped against one or more preconnection elements which extend outwardly from the shaped material; and the resulting product is cut into discrete parts, with the connection elements extending from the resistive material. Reference may be made, for example, to U.S. Pat. Nos. 3,351,882 (Kohler et al), 4,238,812 (Middleman et al, 4,327,351 (Walker), 4,352,083 (Middleman et al), 4,413,301 (Middleman et al), 4,426,633 (Taylor), 4,445,026 (Walker), 4,481,498 (McTavish et al), 4,685,025 (Carlomagno), 4,689,475 (Matthiesen), and 4,800,253 (Kleiner et al), the disclosures of which are incorporated herein by reference.

All of the methods referred to above suffer from serious problems, for example, one or more of: failure of economically attractive processes to provide good contact between the resistive material and the connection element; failure of economically attractive processes to provide good contact between the lead and the first portion of the connection element; failure of the second portion of the connection element to have required properties for connection to other parts of a circuit, e.g. adequate rigidity for insertion into a printed circuit board; and undesirable effects of the connection element on the properties of the resistive element, e.g. excessive physical restriction of a PTC conductive polymer resistive element.

One type of electrical device of particular interest is a circuit protection device in which the resistive element comprises a conductive polymer. Such devices, which exhibit positive temperature coefficient (PTC) behavior, are particularly suitable for providing protection against overcurrent or over-temperature faults in an electrical circuit. Under normal conditions, the device has a low resistance which allows the normal current to flow in the circuit. If, however, the device is exposed to a high ambient temperature or experiences joule heating resulting from a fault current (e.g. a voltage spike), the resistance of the device increases and interrupts the current flow. When the fault condition is removed, the device cools down, the resistance drops, and the normal circuit operation resumes. When the device is in its high resistance state, it is said to have "switched" or "tripped". The "switching temperature", $T_s$, is used herein to denote the temperature at the intersection point of extensions of the substantially straight portions of a plot of the log resistance of the device as a function of temperature which lie on either side of the portion showing a sharp change in slope.

Electrical connection to the circuit protection device is made by means of connection elements which are electrodes, i.e. electrically conductive leads or busbars which are electrically attached to the PTC element which comprises the conductive polymer. When it is desired that the circuit protection device be machine-insertable into a circuit board, it is preferred that at least a portion of the electrode be solid, rather than stranded, wire. Solid wire of a given diameter is generally stiffer than stranded wire of the same diameter, a feature which aids insertion into a hole on a board. In addition, solid wire is not subject to inconsistent dimensions resulting from nonuniform stranding, nor is it subject to unravelling strands or "birdcaging", i.e. the unstranding of wire which occurs when pressure is applied nonuniformly to the end of a stranded wire. Solid wire, however, may be so rigid that the expansion of the conductive polymer in the PTC element during tripping may be restricted, resulting in device failure; the wire may not "give" enough to survive repeated electrical cycles, particularly at high voltages, e.g. greater than 120 volts. In addition, when compared to a stranded wire, the surface area of a solid wire may not be large enough to allow adequate adhesion of the conductive polymer to the electrode. The resulting device will thus have areas of poor contact to the electrode; the contact will deteriorate with each cycle, resulting in eventual device failure.

SUMMARY OF THE INVENTION

In the manufacture of circuit protection devices of the kind described in U.S. Pat. No. 4,685,025 (Carlomagno), a resistive element is formed by continuously melt-extruding a PTC conductive polymer over a pair of wires, cutting the extrudate into discrete lengths, and removing a part of the conductive polymer from each of the discrete lengths, in order to expose the conductors. In further development of such processes, we have realized that the need to remove part of the conductive polymer can be eliminated by using, instead of conventional wires, elongate conductors which are hollow, or which have removable cores, or which otherwise have, or can be treated after the cutting step so as to have, a configuration, e.g. a cavity, which enables a second connection element to be secured to the connection element which is embedded in the conductive polymer. This not only eliminates the waste and effort involved in removing the conductive polymer from each cut length, but also makes it possible to use a second connection element having desired properties, e.g. for insertion into a printed circuit board.

We have also realized, in accordance with the present invention, that such connection elements can also be very usefully employed in a wide variety of other processes for making electrical devices which involve the shaping of malleable insulating or resistive materials in contact with connection elements or preconnection elements. The invention is particularly useful in continuous processes of the kind referred to in the Introduction to the Invention (including those disclosed in the U.S. Patents incorporated by reference), in order to solve or mitigate the various problems referred to. The invention is also useful in processes in which each device is manufactured separately, e.g. by injection molding, in order to simplify the steps of the process and/or complexity of the mold or other equipment. The invention is particularly useful for (and will be described herein chiefly by reference to) devices in which the first connection element is in contact with a resistive element. The term "resistive element" is used herein to include elements which have resistance but substantially no reactance, and elements which have both resistance and reactance. However the invention is also useful for devices which have reactance but no substantial resistance, e.g. capacitors and inductors.

In a first aspect, this invention provides an electrical device which comprises (1) a resistive element which is composed of a first material having a resistivity at 23° C. of $10^{-3}$ to $10^{9}$ ohm-cm; and (2) a first connection element which (a) is composed of a second material having a resistivity at 23° C. of less than $10^{-3}$ohm-cm, (b) defines a cavity into which, when the cavity is empty, a second connection element can be inserted so that it (i) is partially within the cavity, (ii) makes physical and electrical contact with the first connection element, and (iii) protrudes from the cavity, and (c) is in electrical contact with the resistive element.

The term "defines a cavity" is used herein to mean that the first connection element, either alone, or in combination with the resistive element, or in combination with the resistive element and/or another element, e.g. a nonconductive element, defines a configuration of either open or closed cross-section with which the second connection element can interact so as to provide a desired physical and electrical relationship with the first connection element.

When it is stated herein that the cavity is one into which a second connection element can be inserted "when the cavity is empty", this does not mean that the cavity is necessarily empty at the time a second connection element is, in fact, inserted. For example, as further described below, the invention includes processes in which the second connection element is pushed, screwed, or otherwise inserted into a cavity which contains (but is not necessarily filled by) a solid material, thus displacing at least part of the solid material. Furthermore the invention includes such processes in which removal of the solid material, without inserting the second connection element, would result in a cavity which was empty but which had undergone some change, e.g. a change in cross-section, which made it impossible to insert the second connection element.

In a second aspect, the invention provides a method of making an electrical device as defined above, said method comprising (A) subjecting a malleable material to a treatment which brings it into physical and electrical contact with a preconnection element which is composed of the second material and which defines a cavity, the malleable material, after it has been subjected to said treatment, being the first material; and (B) cutting the product of step (A) so that the cavity, when it is empty, is accessible for insertion of a second connection element into the cavity so that the second connection element lies partially within the cavity and protrudes from the cavity.

The term "preconnection element" means an element at least a part of which, after cutting, becomes the first connection element.

In a third aspect, the invention provides a method of making an electrical device which comprises (A) providing an electrical device which comprises (1) a resistive element which is composed of a first material having a resistivity at 23° C. of $10^{-3}$ to $10^{9}$ ohm-cm; and (2) a first connection element which (a) is composed of a second material having a resistivity at 23° C. of less than $10^{-3}$ ohm-cm, (b) defines a cavity which contains a third material which is solid at 23° C., and into which, when the cavity is empty, a second connection element can be inserted so that the second connection element (i) lies partially within the cavity, (ii) makes physical and electrical contact with the first connection element, and (iii) protrudes from the cavity, and (c) is in electrical contact with the resistive element; and (B) removing at least part of the third material from the cavity.

In a fourth aspect, the invention provides a method of making an electrical device which comprises (A) providing an electrical device which comprises (1) a resistive element which is composed of a first material having a resistivity at 23° C. of $10^{-3}$ to $10^{9}$ ohm-cm; and (2) a first connection element which (a) is composed of a second material having a resistivity at 23° C. of less than $10^{-3}$ ohm-cm, (b) defines an empty cavity, and (c) is in electrical contact with the resistive element; and (B) inserting a second connection element partially into the cavity so that it makes physical and electrical contact with the first connection element and protrudes from the cavity.

In a fifth aspect, the invention provides an assembly which comprises (A) a circuit board, and (B) an electrical device which (1) is mounted on the circuit board, (2) comprises a resistive element which is composed of a first material having a resistivity at 23° C. of $10^{-3}$ to $10^{9}$ ohm-cm, (3) comprises two first connection elements which are spaced apart from each other and each of which (a) is embedded in the resistive element and makes electrical contact thereto, (b) is composed of a second material having a resistivity at 23° C. of less than $10^{-3}$ ohm-cm, and (c) defines a cavity into which, when the cavity is empty, a second connection element can be inserted so that it (i) is partially within the cavity, (ii) makes physical and electrical contact with the first connection element, and (iii) protrudes from the cavity, and (4) further comprises two second connection elements, each of which (a) makes physical and electrical contact with a first connection element, (b) is composed of a fourth material which has a resistivity at 23° C. of less than $10^{-3}$ ohm-cm, (c) lies partially within the cavity defined by one of the first connection elements, and (d) protrudes from said cavity.

BRIEF DESCRIPTION OF THE DRAWING

The invention is illustrated in the accompanying drawing in which.

DETAILED DESCRIPTION OF THE INVENTION

Figure 1:
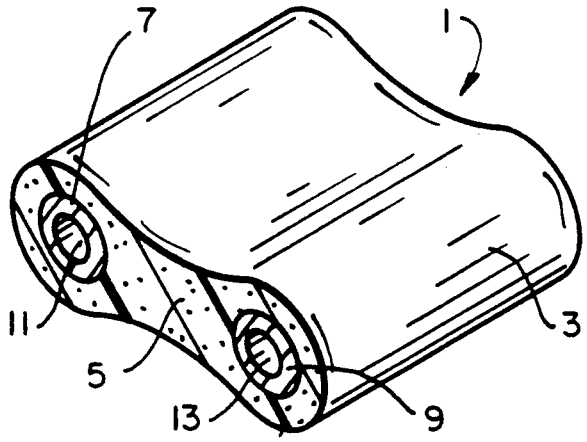
FIG. 1 shows a perspective view of an electrical device of the invention.

The electrical device preferably comprises a resistive element which is composed of a first material. The first material is a conductive material, i.e. a material which has a resistivity of $1\times10^{-3}$ to $1\times10^{9}$ ohm-cm. It is particularly preferred that the first material be a malleable material which can be molded, extruded, or otherwise formed into a desired shape. Suitable materials comprise polymers, metal oxides, and ceramics. In a preferred embodiment of this invention, the first material comprises a conductive polymer composition, i.e. a composition which is composed of a polymeric component, and, dispersed or otherwise distributed in the polymeric component, a particulate conductive filler. The polymeric component is preferably a crystalline organic polymer. Suitable crystalline polymers include polymers of one or more olefins, particularly polyethylene; copolymers of at least one olefin and at least one monomer copolymerisable therewith such as ethylene/acrylic acid, ethylene/ethyl acrylate, and ethylene/vinyl acetate copolymers; melt-shapeable fluoropolymers such as polyvinylidene fluoride and ethylene/tetrafluoroethylene copolymers (including terpolymers); and blends of two or more such polymers. For some applications it may be desirable to blend one crystalline polymer with another polymer, e.g. an elastomer or amorphous thermoplastic polymer, in order to achieve specific physical or thermal properties, e.g. flexibility or maximum exposure temperature.

The particulate conductive filler may be carbon black, graphite, metal, metal oxide, a combination of these, or any other appropriate conductive filler. In some applications, the particulate filler may itself be composed of a polymer matrix in which is dispersed a particulate conductive filler. Examples of this type of conductive polymer composition are found in European Patent Publication No. 231,068 (Barma et al), the disclosure of which is incorporated herein by reference.

The conductive polymer composition may comprise antioxidants, inert fillers, radiation crosslinking agents (often referred to as prorads), stabilizers, dispersing agents, or other components. Dispersion of the conductive filler and other components may be achieved by melt-processing, solvent-mixing, or any other suitable means. Suitable conductive polymer compositions are found in U.S. Pat. Nos. 4,188,276 (Lyons et al), 4,237,441 (van Konynenburg et al), 4,388,607 (Toy et al), 4,514,620 (Cheng et al), 4,545,926 (Fouts et al), 4,560,498 (Hormsa et al), 4,624,990 (Lunk et al), 4,774,024 (Deep et al), and copending, commonly assigned application Ser. Nos. filed Apr. 21, 1980), 06/423,589 (van Konynenburg et al, filed Sep. 27, 1982) now U.S. Pat. No. 5,049,850, 06/720,118 (Soni et al, filed Apr. 2, 1985)now U.S. Pat. No. 4,935,156, 07/75,929 (Barma et al, filed Jul. 21, 1987), 07/416,748 (Shafe et al, filed Oct. 3, 1989), now abandoned in favor of a continuation application Ser. No. 07/462,893, filed Jan. 3, 1990 the disclosures of which are incorporated herein by reference.

In another embodiment, the first material comprises an inorganic material such as a ceramic material, e.g. $BaTiO_3$ or ZnO. The ceramic material may be made by blending inorganic powders to form a ceramic precursor, which can then be heated to form a conductive ceramic, i.e. a ceramic composition which has a resistivity of less than $10^9$ ohm-cm. Any conventional method of preparation may be used.

For many applications, the first material will exhibit PTC behavior in the temperature range of interest when connected to a source of electrical power, i.e. it will show a sharp increase in resistivity with temperature over a relatively small temperature range. In this specification, the term "PTC" is used to mean a material or device which has an $R_{14}$ value of at least 2.5 and/or an $R_{100}$ value of at least 10, and particularly preferred that is should have an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. Common "PTC materials" such as some conductive polymer compositions and some ceramics, e.g. $BaTiO_3$, show increases in resistivity which are much greater than the minimum values presented herein.

The resistive element may be formed in any convenient shape.

The device also comprises, in addition to the resistive element, at least one first connection element. This first connection element, through which electricity is supplied to the resistive element if the device is incorporated into an electrical circuit, is composed of a second material which has a resistivity which is generally less than $1\times10^{-3}$ ohm-cm, and is in any case less than that of the first material. For many applications, the second material is a metal or an alloy, e.g. copper, nickel, aluminum, steel, brass, or a combination of these, although other materials such as graphite fibers or metal-coated glass fibers may be used. In some instances, it is desirable to coat the surface of the first connection element which is adjacent to the resistive element with solder.

The first connection element is in electrical contact with the resistive element. For many applications, the first connection element is in direct physical contact with the first material of the resistive element, but it may be separated from the first material by an intervening layer such as a conductive adhesive or other conductive tie layer. It may be embedded within or attached to the surface of the resistive element. While in most devices the first connection element extends the length of the resistive element and thus defines a cavity or channel through the element, it may be only partially embedded in or in contact with the resistive element, and/or have a cavity which extends only through part of its length. Depending on the application and the nature of the electrical device, there may be one, two, or more first connection elements, which may be the same or different from one another, as defined above, and one, two, or more other connection elements of another, e.g. conventional, type. The first connection element may be formed from solid material or it may be perforated, e.g. in the form of a mesh or an apertured sleeve, so that the first material can penetrate at least partly into the openings and provide enhanced adhesion to the resistive element. In one preferred embodiment, at least part of the surface of the first connection element which contacts the resistive element has a microrough surface, e.g. irregularities which protrude from the surface by a distance of at least 0.03 microns and which have at least one dimension parallel to the surface which is at most 500 microns. Surfaces of this type are frequently copper, nickel, or nickel-coated copper and are often prepared by electrodeposition of the selected metal onto a substrate, e.g. a metal foil or a hollow metal tube. The microroughness, often in the form of spherical nodules, provides enhanced adhesion to a polymer substrate. Such materials are disclosed in U.S. Pat. Nos. 4,689,475 (Matthiesen) and 4,800,253 (Kleiner et al), the disclosures of which are incorporated herein by reference.

The preferred shape and structure of the first connection element are dependent on the particular application and the method of manufacture of the device, provided that the first connection element, or the first connection element in combination with the resistive element or another element, e.g. an insulating element, defines a cavity into which, when the cavity is empty, a second connection element can be inserted. The cross-section of the first connection element may be, for example, circular, rectangular, or square. It may define a cavity of any shape, although in most cases, the shape of the cavity is similar to that of the first connection element. In a preferred embodiment, the first connection element comprises a removable element which lies within the cavity defined by the first connection element and which can be removed from the cavity. For ease of removal, e.g. by pushing or punching out the removable element from the first connection element, the removable element preferably is composed of a third material which is a solid material at 23° C. A particularly preferred first connection element comprises a stranded wire which comprises outer strands positioned against an inner removable core. The core may be a single solid wire, as is preferred, or a plurality of strands. The outer strands provide good adhesion to the first material of the resistive element, and the core can be removed to leave a cavity which can subsequently be filled, at least partially, by the second connection element. For some applications, it is desirable to coat at least the inner surface of the strands of the stranded wire which forms the first connection element, and preferably both these inner strands and the outer surface of the second connection element, with solder. When heated, the solder will melt and readily wet the inserted second connection element to form a good physical and electrical bond. The core may comprise the same material as the outer strands as in conventional stranded wire, or it may be different in order to facilitate removal. Thus the core may be a more rigid or inexpensive material, or it may be a material such as polytetrafluoroethylene (PTFE) or PTFE-coated wire which can be readily removed. Alternatively, the first connection element or the core may comprise a high temperature solder, i.e. one which melts above the normal operating temperature or the switching temperature Ta of the device. For these devices, the second connection element can comprise a preheated pin which melts and displaces the solder as it is inserted, making a good electrical connection.

The second connection element is composed of a fourth material which preferably has a resistivity at 23° C. of less than $10^{-3}$ ohm-cm. This second connection element is inserted into the cavity defined by the first connection element. The second connection element may itself be the means of removing a removable solid core which is at least partially surrounded by the first connection element. When inserted, the second connection element is at least partially within the cavity and makes physical and electrical contact with the first connection element, either directly or through an intermediate layer, e.g. a conductive adhesive or solder. For most devices, the second connection element protrudes from the cavity in order to make connection to another electrical component or a circuit board. It is not necessary that the second connection element entirely fill the cavity, although this is often the case in order to achieve the maximum physical adhesion to the device. When the cavity is in the form of a tunnel and extends throughout the length of the device, the second connection element may protrude from both ends of the cavity, or it may be recessed slightly or substantially from one end of the cavity. The remainder of the cavity may then be filled with another material, e.g. an arc suppressant, solder, solder paste, or a nonconductive material such as an epoxy or an insulating polymer rod.

In an alternative embodiment, the second connection element may be formed by partially pushing out the removable element from the first connection element. If the removable element is a conductive material, e.g. metal wire, it can be used directly to make electrical connection to another component or a circuit board. By this technique, the length by which the second connection element protrudes from the cavity can be readily controlled.

The shape of the second connection element may conform to the shape of the cavity formed by the first connection element, e.g. a round second connection element inserted into a round cavity, or it may be different, e.g. a square second connection element inserted into a round cavity. When the first connection element comprises a stranded wire, it may be desirable to use a second connection element with a shape, e.g. diamond or square, which can readily be inserted between the adjacent wire strands. It may also be desirable to use a second connection element which will deform the first connection element, e.g. to improve the electrical contact between the first and second connection elements or between the first connection element and the resistive element. The second connection element may comprise more than one part, each having a different shape, in order to meet requirements of machine-insertability, "stand-off" from a substrate, or other electrical connection or physical configuration. For some applications, e.g. surface-mounting of electrical devices, it is desirable that the portion of the second connection element which is to be connected to the circuit, e.g. inserted into a circuit board, have one cross-section, e.g. square or rectangular, but the necessary electrical or physical connection, e.g. pull-strength, of the second connection element to the resistive element is better met by a different cross-section, e.g. circular. In this case, the second connection element can be stamped or otherwise formed so that a first portion to be inserted into the cavity has one cross-section, e.g. round, and a second portion to be connected, e.g. inserted into a board, has a different cross-section, e.g. square. Additional positioning marks or indicators, e.g. wider regions, can be present to ensure insertion to a correct distance.

It is preferred that the inserted second connection element have adequate pull-strength, i.e. it have a sufficiently tight fit in the cavity that it will not easily come out either at room temperature or under normal operating conditions, e.g. at $T_s$ in the case of circuit protection devices. For most applications, a minimum pull-strength of at least 100 grams, preferably at least 250 grams, particularly at least 500 grams, e.g. 1000 grams, measured at 23° C. is adequate. The pull-strengths referred to above are measured by clamping and holding the device stationary while the force (in grams) required to pull the second connection element from the cavity is recorded. It is preferred that the device have a pull strength of at least 175 g/linear centimeter of cavity length, particularly at least 400 g/linear cm, especially at least 850 g/linear cm, e.g. 1500 g/linear cm, measured at 23° C. Although second connection elements of any size can be used, one method of producing devices which have adequate pull strength is to insert a second connection element which has at least one cross-sectional dimension which is slightly larger than the corresponding dimension of the cavity. Thus it is preferred that the largest dimension of the cross-section of the portion of the second connection element to be inserted is at least 0.0005 inch (0.00127 cm) larger than, particularly 0.0010 inch (0.00254 cm) larger than, especially at least 0.0015 inch (0.00381 cm) larger than, the largest dimension of the cross-section of the cavity. For example, useful devices are made when a round second connection element with a diameter of 0.0265 inch (0.0673 cm) is inserted into a round cavity with a diameter of approximately 0.025 inch (0.0635 cm). The second connection may have a uniform cross-section or it may be "barbed", i.e. have one or more areas of larger cross-section. These barbed regions can provide high pressure contact points with the first connection element when inserted into the cavity, producing enhanced pull-strength. Alternatively, they can act as positioning markers and indicate the proper insertion length into the device. If a second connection element with a larger size than the cavity is used, it is necessary that either the resistive element comprise a first material which is slightly resilient, or that either the first connection element or the second connection element comprise a resilient material or otherwise be constructed so that one or the other or both can be deformed, preferably elastically.

Devices of the invention which are particularly preferred are those which comprise two first connection elements, each embedded in the resistive element and spaced-apart from the other, and each having a generally annular cross-section which defines a generally cylindrical cavity. The cavity is preferably open at both ends. Metal second connection elements, e.g. pins attached to a bandolier for continuous production or electrodes projecting from the surface of a substrate, are preferably inserted into the cavity. Due to the ease of manufacture and the options for various resistivity levels, the first material for these devices often comprises a conductive polymer. The invention is particularly useful for the manufacture of devices in which the connection elements are as defined above but the devices are otherwise similar to those described in U.S. Pat. Nos. 4,352,083 (Middleman et al), 4,413,301 (Middleman et al), 4,481,198 (McTavish et al), 4,685,025 (Carlomagno). 4,724,417 (Au et al), 4,774,024 (Deep et al), and 4,845,838 (Jacobs et al), the disclosures of which are incorporated herein by reference.

In an alternative construction, the resistive element may have a coaxial construction. In this embodiment, the first connection element may be either the internal electrode, as is preferred, or the external electrode, or both.

Devices of the invention can be readily manufactured by a method of the invention. In a first step, a malleable material is treated so that it is brought into physical and electrical contact with a preconnection element. The treatment can be melt-shaping, e.g. melt-extrusion or injection-molding, solvent-coating, or sintering, in the case of a polymeric first material; sintering or compression-molding in the case of a ceramic; or any other suitable process. Once treated, e.g. melt-shaped or sintered, the malleable material forms the first material. The preconnection element is composed of the second material. It may be an elongate wire or an elongate tube, both of which are preferred when the manufacturing process is a continuous one, or any other element which, when cut, will define a cavity. In a second step, the treated material from the first step is cut so that the cavity, when it is empty, is accessible for insertion of the second connection element. If the preconnection element comprises a tube, the treated material, when cut, will expose an empty cavity, ready for immediate insertion of the second connection element. If the preconnection element comprises a wire or other element, e.g. a stranded wire, with a removable element, the treated material, when cut, will expose the removable element, which when at least partially removed, will define a cavity. If the cavity is filled during the first step by a third material which is solid, the method may comprise a third step which follows the cutting step and in which at least part of the third material is removed to produce a cavity. It is particularly preferred, when the malleable material is a polymer such as a conductive polymer, that the malleable material be continuously shaped, e.g. extruded, around a pair of parallel elongate preconnection elements, thus embedding the preconnection elements in the extruded material. The shaped product is then cut into discrete pieces, each of which can be used to make an electrical device.

When the first connection element comprises a third material which must be at least partially removed to yield an empty cavity, one method of the invention includes providing an electrical device which comprises that first connection element and then removing at least part of the third material. The second connection element can then be inserted. Although the step for removal of the third material and the step for insertion of the second connection element are normally performed sequentially, in a preferred process the second connection element can be inserted while simultaneously pushing out the removable element. Ejection of the removable element can be accomplished by any convenient physical or chemical means, e.g. pushing or tapping it out or chemically dissolving it. The second connection element can be designed so as to be screwed into position, either during or after the removal of the third material.

The invention is illustrated by the drawing in which FIG. 1 shows an electrical device 1 comprising a resistive element 3 which is composed of a conductive polymer composition 5. Two spaced-apart first connection elements 7, 9 comprising metal tubes are embedded in the resistive element 3. In this embodiment the cavities 11, 13 defined by the first connection elements 7, 9 are empty.

Figure 2:
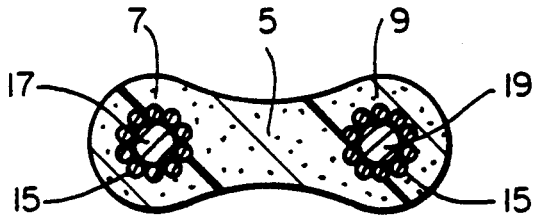
FIG. 2 shows a cross-sectional view of another electrical device of the invention.

FIG. 2 shows an electrical device 1 in which the removable elements 17, 19 within the cavity defined by the two first connection elements 7, 9 have not been removed. In this embodiment, the first connection elements 7, 9 are formed from stranded wire. The individual wire strands 15 surround and are positioned against the removable elements 17, 19. The removable element may be made from a plurality of metal wire strands although in this device, the removable element comprises a single center strand of the wire.

Figure 3:
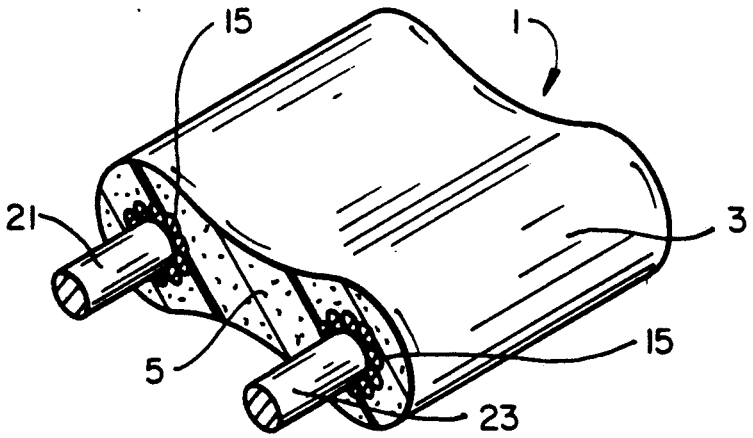
FIG. 3 shows a perspective view of the electrical device of FIG. 2 after insertion of a second connection element according to a method of the invention.

FIG. 3 shows the device 1 of FIG. 2 following removal of the removable elements 17, 19 and replacement by second connection elements 21, 23. The second connection elements may, as in this illustration, protrude from the resistive element 3. Alternatively, the second connection elements 21, 23 may be provided by pushing the removable elements 17, 19 partially out from the first connection element.

Figure 4:
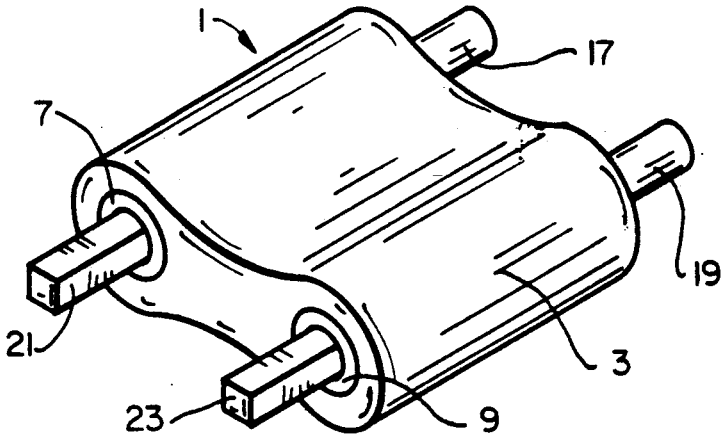
FIG. 4 shows a perspective view of an electrical device of the invention as it is being prepared.

FIG. 4 shows a device 1 during the process in which removable elements 17, 19 are being pushed from the first connection elements 7, 9 by second connection elements 21, 23. In this embodiment, the removable elements 17, 19 and the second connection elements 21, 23 have different shapes.

Figure 5:
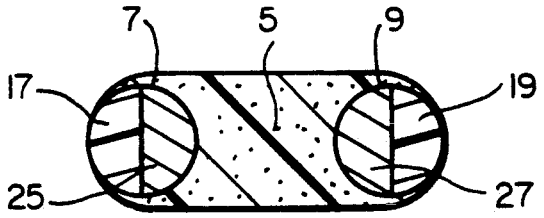
FIG. 5 shows a cross-sectional view of another embodiment of the invention.

FIG. 5 shows in cross-section a device 1 in which the first connection elements 7, 9 comprise a solid wire 25, 27 and a removable element 17, 19 which is polymeric. The removable elements 17, 19 can be pushed out or otherwise removed and a second connection element can be inserted into the remaining channel, e.g. snapped into place.

Figure 6:
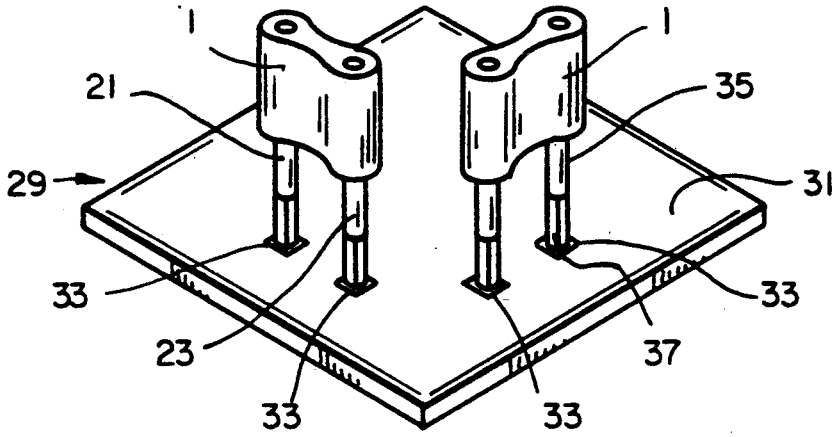
FIG. 6 shows a perspective view of an assembly of the invention.

FIG. 6 shows an assembly 29 in which two electrical devices 1 are attached to a circuit board 31 by insertion into holes 33. In this assembly, the second connection element 21 or 23 has a first part 35 which has a shape, e.g. a circular cross-section, suitable for making good physical and electrical connection to the first connection member and a second part 37 which has a shape, e.g. a rectangular cross-section, suitable for making good physical connection to the circuit board 31.

The invention is illustrated by the following examples in which Example 1 is a comparative example showing a conventional device.

EXAMPLE 1

The following ingredients were dry-blended, mixed in a Banbury mixer, and pelletized: 35% by volume high density polyethylene (Petrothene LB832, available from USI), 36% carbon black (Black Pearls 280, available from Cabot), 27.8% alumina trihydrate (Solem 916SP, available from J. M. Huber), and 1.2% antioxidant [an oligomer of 4,4-thio bis(3-methyl 1-6-t-butyl phenol) with an average degree of polymeris 3 to 4, as described in U.S. Pat. No. 3,986,981]. Using a Brabender cross-head extruder fitted with a dogbone-shaped die, the pellets were melt-extruded at a temperature of about 160° C. around two 20 AWG (19 strand/32 gauge) nickel-coated copper wires which had been coated with a graphite/silicate composition (Electrodag 181, available from Acheson Colloids). The extrudate was cut into pieces each having a length of 0.320 inch (0.81 cm), and the conductive polymer was removed from one end of the piece to give a device with a length of 0.210 inch (0.533 cm), a width of about 0.310 inch (0.787 cm), a center thickness of about 0.095 inch (0.241 cm), and an electrode spacing from wire center to wire center of about 0.200 inch (0.508 cm). A solid 22 AWG tin-coated copper conductor was welded to each of the exposed stranded electrodes. The devices were heat-treated in a nitrogen atmosphere by increasing the temperature to 150° C. at 0° C./min, maintaining them for 1 hour at 150° C., and cooling them to 20° C. at 10° C./min. The devices were then crosslinked by means of a 2.5 MeV electron beam to a dose of 25 Mrad, heat-treated again as described above, irradiated in a second step to a dose of 150 Mrad, and heat-treated a third time using the procedure described above. Each device was then inserted into an alkyd polyester thermoset plastic box, which enclosed, but did not contact, the device.

The electrical stability of the devices as indicated by their voltage withstand performance was determined by testing them using the following circuit. The device was connected in series in a circuit which consisted of a 600 volt AC power source, a switch, the device, and a resistor in series with the device, the device being in still air at 23° C. and the resistor being of a size such that when the switch was closed, the initial current was 1 amp. In the test, the switch was closed for 2 seconds, sufficient time for the device to trip, and the device was allowed to cool for 90 seconds before the switch was again closed for 2 seconds. This sequence was continued until the device failed (as evidenced by significant resistance increase, e.g. 40%, or visible arcs or flames), or until 60 cycles were completed. The resistance of the cooled device (at 23° C.) was measured for each device after each cycle. The results, including the average resistance and the range of the device resistance for the 40 devices tested, are shown in Table I. During the test four devices showed high resistance failure; there were no arcing failures.

EXAMPLE 2

Using a Brabender extruder and the conditions previously described, the compound described in Example 1 was extruded over two graphite-silicate coated 18 AWG wires each consisting of a center 22 AWG solid steel wire (0.025 inch/0.0635 cm diameter) surrounded by twelve strands of 32 AWG nickel-coated copper conductor. Using a saw, the extrudate was cut into pieces each having a length of 0.210 inch (0.533 cm). Using a steel pin, the center 22 AWG solid wire was pushed out from each wire and was replaced with a solid tin-coated brass pin with a diameter of about 0.0265 inch (0.067 cm). The devices were heat-treated, irradiated, inserted into a box, and tested as described in Example 1. The test results are shown in Table I. During the 60 cycles, there were no high resistance or arcing failures.

TABLE I

| | Resistance at 23° C. (ohms) | | | |
|---|---|---|---|---|
| Cycle No. | 0 | 20 | 40 | 60 |
| Example 1 | | | | |
| Resistance | 8.37 | 10.90 | 10.82 | 10.68 |
| Range | 7.8-10.6 | 10.5-11.2 | 10.4-11.1 | 10.5-11.2 |
| Example 2 | | | | |
| Resistance | 7.98 | 9.57 | 9.61 | 9.38 |
| Range | 7.7-9.0 | 9.5-10.6 | 9.3-10.2 | 9.1-10.0 |

What is claimed is:

1. A method of making an electrical device which comprises (1) a resistive element which is composed of a first material having a resistivity at 23° C. of $10^{-3}$ to $10^{9}$ ohm-cm; and (2) a first connection element which (a) is composed of a second material having a resistivity at 23° C. of less than $10^{3}$ ohm-cm, (b) defines a cavity into which, when the cavity is empty, a second connection element can be inserted so that it (i) is partially within the cavity, (ii) makes physical and electrical contact with the first connection element, and (iii) protrudes from the cavity, and (c) is in electrical contact with the resistive element, which method comprises (A) subjecting a malleable material to a treatment which brings it into physical and electrical contact with a preconnection element which is composed of the second material and which defines a cavity, the malleable material, after it has been subjected to said treatment, being the first material; and (B) cutting the product of step (A) so that the cavity, when it is empty, is accessible for insertion of a second connection element into the cavity so that the second connection element lies partially within the cavity and protrudes from the cavity.

2. A method according to claim 1 wherein in step (A) the malleable material is continuously shaped around a pair of parallel elongate preconnection elements to provide an elongate element comprising the preconnection elements embedded in the malleable material, and in step (B) the elongate element is cut into discrete lengths.

3. A method according to claim 2 wherein the malleable material is a conductive polymer which (a) comprises (i) an organic polymer, and (ii) dispersed in the polymer, a particulate conductive filler, and (b) exhibits PTC behavior.

4. A method according to claim 3 wherein the conductive polymer is melt-extruded around the preconnection elements.

5. A method according to claim 1 wherein the malleable material comprises powdered inorganic materials which can be heated together to form a conductive ceramic, and wherein step (A) includes heating the shaped malleable material to form a conductive ceramic.

6. A method according to claim 1 wherein the cavity, during step (A), is filled by a third material which is solid during step (A) and wherein the method further comprises removing at least part of the third material after step (B).

7. A method according to claim 11 wherein the preconnection element is a tube.

8. A method of making an electrical device which comprises (A) providing an electrical device which comprises (1) a resistive element which is composed of a first material having a resistivity at 23° C. of $10^{-3}$ to $10^{9}$ ohm-cm; and (2) a first connection element which (a) is composed of a second material having a resistivity at 23° C. of less than $10^{-3}$ ohm-cm, (b) defines a cavity which contains a third material which is solid at 23° C., and into which, when the cavity is empty, a second connection element can be inserted so that the second connection element (i) lies partially within the cavity, (ii) makes physical and electrical contact with the first connection element, and (iii) protrudes from the cavity, and (c) is in electrical contact with the resistive element; and (B) removing at least part of the third material from the cavity.

9. A method of making an electrical device which comprises (A) providing an electrical device which comprises (1) a resistive element which is composed of a first material having a resistivity at 23° C. of $10^{-3}$ to $10^{9}$ ohm-cm; and (2) a first connection element which (a) is composed of a second material having a resistivity at 23° C. of less than $10^{-3}$ ohm-cm, (b) defines an empty cavity, and (c) is in electrical contact with the resistive element; and (B) inserting a second connection element partially into the cavity so that it makes physical and electrical contact with the first connection element and protrudes from the cavity.

* * * * *

UNITED STATES PATENT AND TRADEMARK OFFICE

CERTIFICATE OF CORRECTION

PATENT NO. : 5,122,775

DATED : June 16, 1992

INVENTOR(S) : Fang, et al

It is certified that error appears in the above-indentified patent and that said Letters Patent is hereby corrected as shown below:

Column 6, line 19, after "Ser. Nos." insert --06/141,989 (Evans,--.

Column 6, line 19, after "April 21, 1980)," insert --now U.S. Patent No. 5,049,850,--.

Column 6, line 21, replace "now U.S. Patent No. 5,049,850," by --now U.S. Patent No. 4,935,156,--.

Column 6, line 22, replace "now U.S. Patent No. 4,935,156," by --now abandoned in favor of a continuation application, Serial No. 07/462,893, filed January 3, 1990,--

Column 6, line 24 to 26, replace ", now abandoned in favor of a continuation application Serial No. 07/462,893, filed January 3, 1990," by --, now U.S. Patent No. 4,980,541,--

Column 8, line 18, replace "Ta" by --$T_s$--.

UNITED STATES PATENT AND TRADEMARK OFFICE

CERTIFICATE OF CORRECTION

PATENT NO. : 5,122,775

DATED : June 16, 1992

INVENTOR(S) : Fang, et al

It is certified that error appears in the above-indentified patent and that said Letters Patent is hereby corrected as shown below:

Column 12, line 10, replace "polymeris 3" by --polymerisation of 3--.

Column 12, line 28, replace "0°C./min," by --10°C./min,--

Col. 14, claim 7, line 18, replace "claim 11" by --claim 1--.

Signed and Sealed this

Sixteenth Day of November, 1993

Bruce Lehman

*Attest:*

BRUCE LEHMAN

*Attesting Officer*

*Commissioner of Patents and Trademarks*